US008573472B2

(12) United States Patent
Block

(10) Patent No.: US 8,573,472 B2
(45) Date of Patent: Nov. 5, 2013

(54) REINFORCED CARTON, BLANK AND ASSOCIATED METHOD OF CONSTRUCTION

(75) Inventor: Steven J. Block, Amelia, OH (US)

(73) Assignee: The C.W. Zumbiel Company, Hebron, KY (US)

( * ) Notice: Subject to any disclaimer, the term of this patent is extended or adjusted under 35 U.S.C. 154(b) by 292 days.

(21) Appl. No.: 13/173,019

(22) Filed: Jun. 30, 2011

(65) Prior Publication Data

US 2013/0001236 A1 Jan. 3, 2013

(51) Int. Cl.
*B65D 5/00* (2006.01)

(52) U.S. Cl.
USPC ..... 229/136; 229/142; 229/159; 229/185.1

(58) Field of Classification Search
USPC ..... 229/142, 159, 185.1, 132, 136
See application file for complete search history.

(56) References Cited

U.S. PATENT DOCUMENTS

| | | | | |
|---|---|---|---|---|
| 1,634,073 | A | 6/1927 | Labombarde | |
| RE1,693 | E | 4/1928 | Shafer | |
| 1,784,317 | A | 12/1930 | Stokes | |
| 2,555,581 | A | 6/1951 | Dunning | |
| 2,835,432 | A * | 5/1958 | Wilmot | 229/120 |
| 2,843,308 | A * | 7/1958 | Paige | 229/185.1 |
| 2,933,228 | A | 4/1960 | Guyer | |
| 3,119,544 | A | 1/1964 | Cope et al. | |
| 3,189,249 | A * | 6/1965 | Fallert | 229/185 |
| 3,190,533 | A * | 6/1965 | Larson | 229/185 |
| 3,236,436 | A | 2/1966 | Cheeley | |
| 3,278,108 | A * | 10/1966 | Paige | 229/185.1 |
| 3,355,081 | A | 11/1967 | Kachurchak | |
| 3,581,973 | A | 6/1971 | Turpin | |
| 3,660,116 | A | 5/1972 | Clark | |
| 3,825,170 | A | 7/1974 | Aust et al. | |
| 3,896,988 | A | 7/1975 | Mayled | |
| 4,054,203 | A | 10/1977 | Farquhar | |
| 4,244,510 | A * | 1/1981 | Snyder et al. | 229/117.25 |
| 4,757,938 | A | 7/1988 | Collins | |
| 5,072,876 | A | 12/1991 | Wilson | |
| 5,476,219 | A | 12/1995 | Kim | |
| 5,873,516 | A | 2/1999 | Boggs | |
| 6,170,741 | B1 | 1/2001 | Skolik et al. | |

(Continued)

OTHER PUBLICATIONS

International Searching Authority; The International Search Report and the Written Opinion of the International Searching Authority, or the Declaration; PCT/US2012/043951; Sep. 14, 2012, 12 pgs.

*Primary Examiner* — Nathan J Newhouse
*Assistant Examiner* — Scott McNurlen
(74) *Attorney, Agent, or Firm* — Wood, Herron & Evans, LLP

(57) ABSTRACT

A paperboard carton blank is formed into a carton from an integral sheet of foldable material, such as paperboard. The carton includes a number of sides serially connected to one another each having a top end spaced from a bottom end. A number of top and bottom flaps are each foldably connected to the top and bottom end, respectively, of one of the sides and the associated flaps combine to form top and bottom ends of the carton. One or more struts extend beyond the distal ends of at least some of the top or bottom flaps and are folded into face to face juxtaposition and secured onto an inside face of the side associated with the flap to which it is connected to thereby reinforce the associated side and inhibit deformation of the carton.

27 Claims, 10 Drawing Sheets

(56) References Cited

U.S. PATENT DOCUMENTS

| | | | | |
|---|---|---|---|---|
| 6,968,992 | B2 | 11/2005 | Schuster | |
| 7,743,970 | B2 | 6/2010 | Bates et al. | |
| 2003/0141356 | A1* | 7/2003 | Sheffer | 229/164 |
| 2004/0084515 | A1 | 5/2004 | Rochefort et al. | |
| 2005/0017063 | A1 | 1/2005 | Noone et al. | |
| 2005/0263574 | A1 | 12/2005 | Schuster | |
| 2007/0063005 | A1* | 3/2007 | Gomes et al. | 229/120.09 |
| 2009/0121003 | A1 | 5/2009 | Garner | |
| 2010/0314437 | A1* | 12/2010 | Dowd | 229/185.1 |

* cited by examiner

REINFORCED CARTON, BLANK AND ASSOCIATED METHOD OF CONSTRUCTION

BACKGROUND OF THE INVENTION

This invention relates generally to the packaging art and, more particularly, to a carton that is economical to manufacture and robust in use.

In recent years, a variety of consumer boxes and cartons have been developed for packaging, shipping, storing, carrying, and dispensing a variety of products. An example of such packages is a carton for carrying beverages or food products. A typical container for such products may often be formed from a paperboard carton blank. Carton manufacturers often face the challenge of providing a carton having an ergonomic construction that is sufficiently strong to withstand the stress generated by the weight of articles enclosed therein and various shipping and storage arrangements. One approach to resolving this quandary is to construct the carton from a stronger material such as paperboard or from a sheet of material of a relatively higher caliper. As fully enclosed cartons typically have six walls (top, sides, bottom, and ends) that are formed from a single sheet of material, and cost tends to increase according to the strength and thickness of material used to construct the carton walls, this approach is an expensive one because it effectively amounts to reinforcing all of the walls of the carton irrespective of the relative magnitude of the forces borne by each wall or portion of the carton.

According to another approach, additional material is applied to or around various areas of the carton as needed to increase its integrity. However, it is not desirable to form a carton from multiple sheets of material during production, construction and manufacture because the logistics of attaching additional components to a carton blank during processing on high speed production lines is problematic.

It has been difficult, however, to provide an economical carton which combines the requisite strength for handling, transport and storage and at the same time offers convenient and economical manufacturing techniques.

What is needed is a carton that is formed from a single blank, and which provides a reinforced areas integrated into the carton blank so that the carton walls are efficiently constructed without wasting expensive material in areas of the carton that are less likely to fail.

Therefore, an improved carton and carton blank is needed that satisfies these and other shortcomings associated with known carton designs.

SUMMARY OF THE INVENTION

This invention solves these and other problems and, in one embodiment, includes a paperboard carton blank, in another embodiment is a carton formed from the carton blank and in a still further embodiment is a method of constructing such a carton. Briefly, the sleeve style carton is formed from a paperboard blank into a tubular configuration with open ends. The end panels are formed from flaps which extend from the various sides, top and bottom panels of the carton. The flaps are folded onto each other and form a composite end panel.

In some applications, the formed carton is filled and stacked on its end with the composite end panels being on the top/bottom. To increase the compression strength of the carton in this upright configuration, this invention includes reinforcing struts attached to the distal end of each flap. The struts are folded into face-to-face juxtaposition on the respective sides of the carton and adjacent to the associated fold line joining the flap to the end of the side panel. The struts are folded onto and glued to the associated side panel. This provides added strength to the carton when it is erected and stacked on its end in an upright configuration to inhibit the side panels from being crushed in those areas. An oval or other shaped hole may be provided at the juncture of the strut and the flap on the side panels of the carton to facilitate folding and avoid binding of the carton blank material. With the struts, thinner and often less expensive paperboard can be used to make the carton blank while still providing adequate strength to avoid deformation of the carton.

A carton of one embodiment is formed from a single, integral sheet of foldable material, such as paperboard. The carton includes a number of sides serially connected to one another and each of the sides has a top end spaced from a bottom end. A number of top flaps are each foldably connected to the top end of one of the sides and the top flaps combine to form a top end of the carton. Similarly, a number of bottom flaps are each foldably connected to the bottom end of one of the sides and the bottom flaps combine to form a bottom end of the carton.

One or more struts extend from the distal ends of at least some of the top or bottom flaps and are folded into face to face juxtaposition and secured onto an inside face of the side associated with the flap to which it is connected to thereby reinforce the associated side and inhibit deformation of the carton. The carton construction and associated struts are particularly advantageous to resist buckling, crushing or deformation of the carton from a longitudinal direction and when the cartons are filled and stacked one on top of another for storage, display or shipping.

In a further embodiment, each strut is connected to the associated flap by a bridge and the bridge is integrally joined with the associated strut and flap. The strut may be directly adjacent to the associated flap to which it is connected when the strut is secured to the associated side of the carton.

In a still further embodiment, a hole in the sheet of material adjacent to the strut and positioned at a juncture between the flap to which the strut is connected and the associated side advantageously inhibits binding of the sheet of material when the flap is folded relative to the associated side. The carton may have a strut connected to each of the flaps on the top and bottom ends to provide added strength to the carton to resist deformation and buckling.

Due at least in part to the robust character of the carton with the reinforcing struts according to various embodiments of this invention, the paperboard used to construct the carton may be thinner than prior paperboard carton blanks while still providing a robust and crush resistant carton formed from a more economically efficient carton blank.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
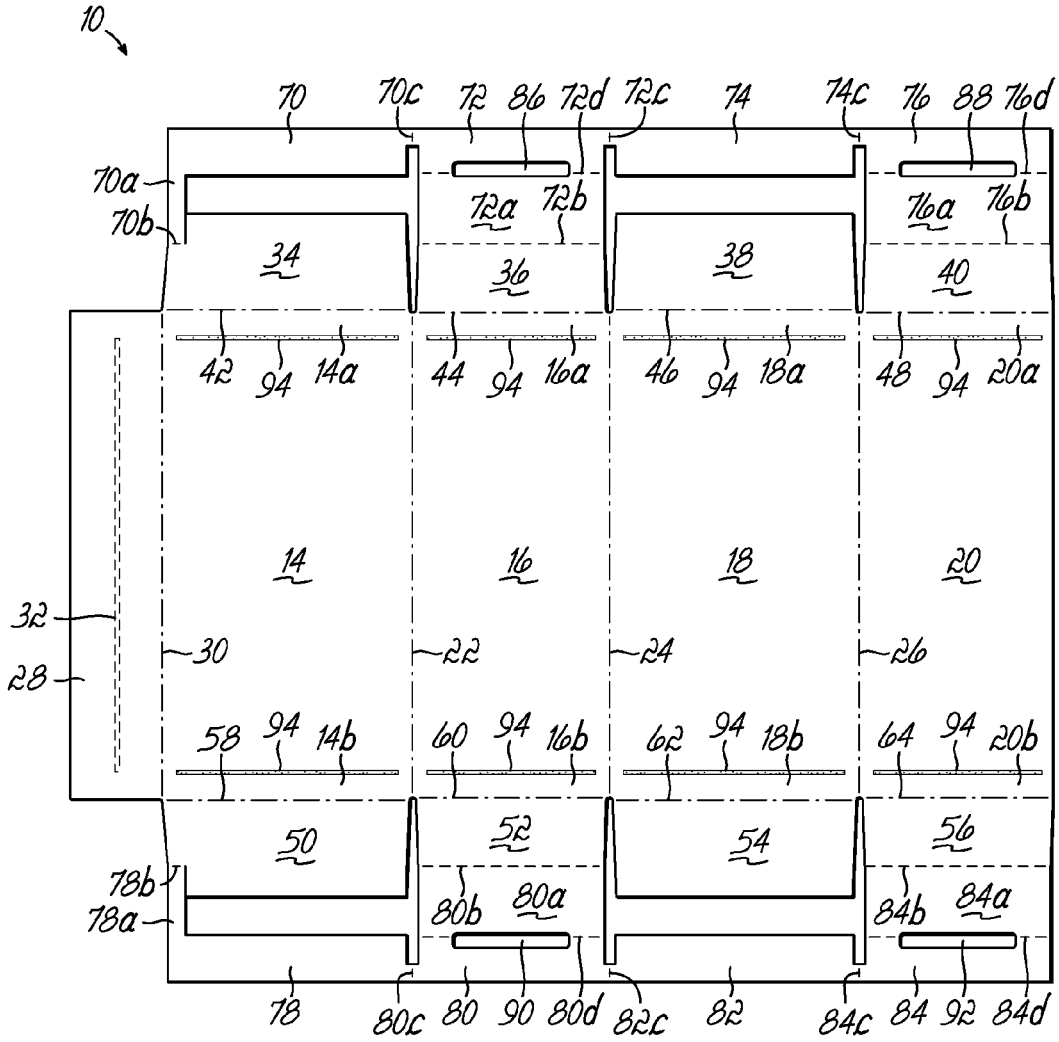
FIG. 1 is a plan view of a carton blank according to one embodiment of this invention.
Figure 6:
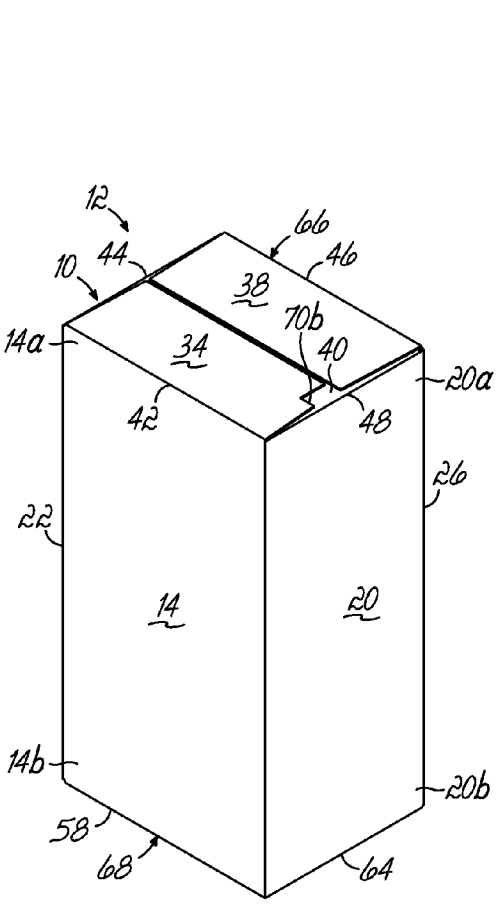
FIG. 6 is a perspective view of the carton formed from the carton blank of FIG. 1.

Referring to FIG. 1, one embodiment of a carton blank 10 according to this invention is shown. The carton blank 10 is suitable for forming into a carton 12 as shown in FIG. 6. The carton blank 10 according to various embodiments of this invention is formed from a single sheet of paperboard which may be 0.028 inches thick of a custom kote paperboard or another type of paperboard or other material as is appropriate within the scope of this invention. The various components, elements and features of the carton blank 10 are integrally formed with each other and the blank 10 is typically stamped or cut from a single sheet of paperboard or other material.

The carton blank 10 includes a number of serially connected sides or side panels 14, 16, 18, 20, four of which are shown in the carton blank 10 of FIG. 1. In the particular embodiment of the carton blank 10 shown in FIG. 1, each side 14, 16, 18, 20 has a generally rectangular configuration in which a top end 14*a*, 16*a*, 18*a*, 20*a* of the side as shown in FIG. 1 is spaced longitudinally from a bottom end 14*b*, 16*b*, 18*b*, 20*b* of the respective side. A series of three spaced and longitudinally extending side fold lines 22, 24, 26 are each positioned between a pair of adjacent sides as shown in FIG. 1 to allow the sides 14, 16, 18, 20 to be folded relative to one another when erecting the carton 12 from the carton blank 10. A side flap 28 is joined to the lateral outer edge of one of the sides 14 via a side fold line 30. The side flap 28 includes a glue strip 32 which attaches the side flap 28 to an inner face of the opposite side 20 to form the carton blank 10 into a tubular configuration (FIG. 4) while the carton 12 is being erected from the blank 10. In one embodiment, the strength of the carton 12 and blank 10 is increased by orienting the grain of the paperboard in a generally longitudinal direction extending between the top and bottom ends of the sides.

As shown in FIG. 1, the carton blank to includes a number of top flaps 34, 36, 38, 40, each of which is connected to the top end 14*a*, 16*a*, 18*a*, 20*a* of one of the sides 14, 16, 18, 20 via a laterally extending flap fold line 42, 44, 46, 48. Similarly, a number of bottom flaps 50, 52, 54, 56 are each attached to the bottom end 14*b*, 16*b*, 18*b*, 20*b* of the associated sides 14, 16, 18, 20 via a laterally extending flap fold line 58, 60, 62, 64. The top flaps 34, 36, 38, 40 combine to form a top 66 of the erected carton 12 when each top flap is folded about the associated flap fold line 42, 44, 46, 48 to be generally perpendicular to the respective side as shown generally in FIG. 6. Similarly, the bottom flaps 50, 52, 54, 56 combine to form a bottom 68 of the carton 12 when each bottom flap is formed to be generally perpendicular about the associated fold line 58, 60, 62, 64 to the respective side.

According to various embodiments of this invention, a strut 70, 72, 74, 76, 78, 80, 82, 84 is connected to the distal terminal edge of each top flap 34, 36, 38, 40 and each bottom flap 50, 52, 54, 56. While the carton blank 10 of FIG. 1 shows a strut connected to each top and bottom flap, those of ordinary skill in the art will appreciate that other arrangements and configurations of the carton 12 and associated carton blank 10 are possible within the scope of this invention in which the struts are only on the top flaps or the bottom flaps or only on selected top or bottom flaps. Each strut 70, 72, 74, 76, 78, 80, 82, 84 may be connected to the respective flap via a bridge 70*a*, 72*a*, 74*a*, 76*a*, 78*a*, 80*a*, 82*a*, 84*a*. Referring to FIG. 1, the bridges 70*a*, 78*a* associated with the top and bottom flaps 34, 50 are narrow elements attached to the respective flap 34, 50 at the outer lateral edge of the flap. Other embodiments of the bridges 72*a*, 76*a*, 80*a*, 84*a* shown in FIG. 1 extend substantially the entire width of the associated strut 72, 76, 80, 84 and associated flap 36, 40, 52, 56. In still other embodiments, the strut 74, 82 is connected to the carton blank 10 via the adjacent struts 72, 76 and 80, 84 associated with the respective flaps and sides such that flaps 38, 54 do not have a bridge folded thereon when the carton is erected (see FIGS. 3-5). Each bridge 70, 72, 76, 78, 80, 84 is connected to the respective flap 34, 36, 40, 50, 52, 56 via a bridge fold line 70*b*, 72*b*, 76*b*, 78*b*, 80*b*, 84*b*. Each strut is joined to the adjacent strut via a strut fold line 70*c*, 72*c*, 74*c*, 80*c*, 82*c*, 84*c*. The struts 72, 76, 80, 84 which extend substantially the entire width of the associated flap 36, 40, 52, 56 each include a fold line 72, 76*d*, 80*d*, 84*d* extending laterally between the flap and the strut. Coincident with the fold line 72*d*, 76*d*, 80*d*, 84*d* is a hole 86, 88, 90, 92 which may be rectangular, oval or of another configuration and the purpose and function of the hole 86, 88, 90, 92 will be described later herein. A series of glue lines 94 are positioned proximate the top and bottom ends 14*a*, 16*a*, 18*a*, 20*a*, 14*b*, 16*b*, 18*b*, 20*b* of each side 14, 16, 18, 20 which will secure the associated strut 70, 72, 74, 76, 78, 80, 82, 84 to the side as will be described later herein.

Figure 2:
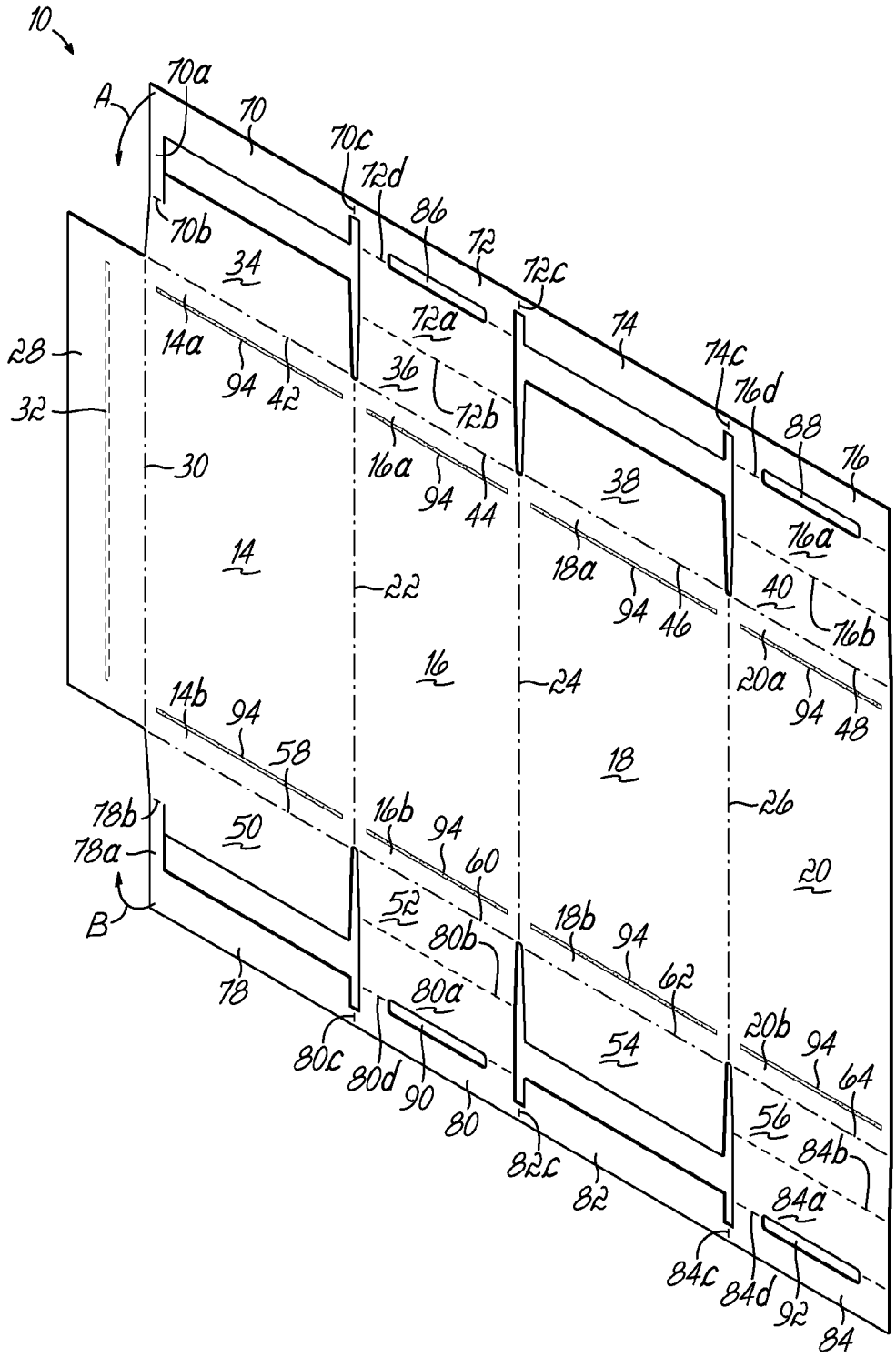
FIG. 2 is a perspective view of the carton blank of FIG. 1 with reinforcing struts connected to various flaps on the carton blank being folded as shown by the arrows.
Figure 3:
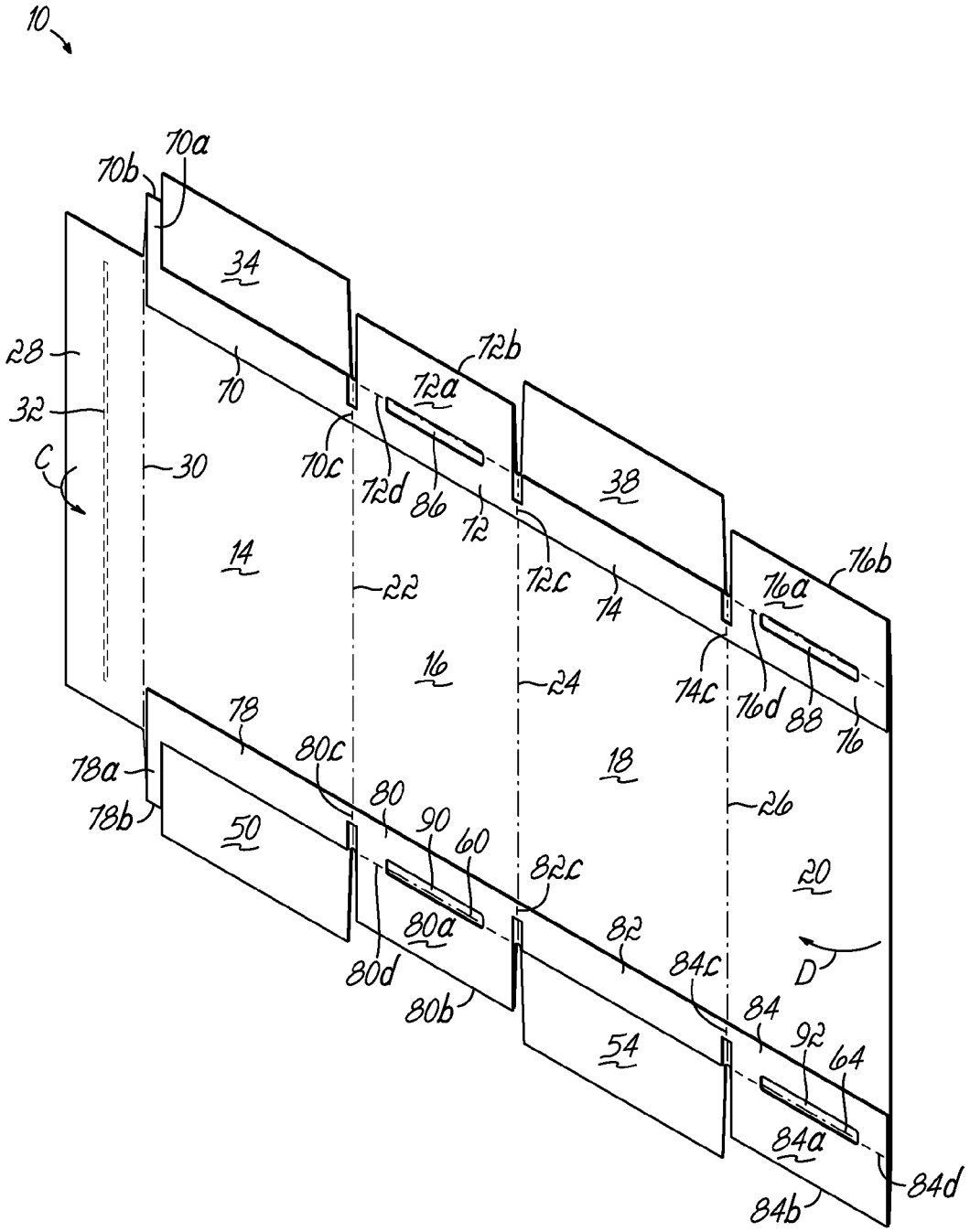
FIGS. 3-5 are sequential views of the carton blank of FIGS. 1-2 being folded into a closed ended carton.

Referring to FIGS. 2-5, one embodiment of the method for erecting the carton 12 from the carton blank 10 of FIG. 1 is shown. Initially as shown in FIG. 2, the struts 70, 72, 74, 76 associated with the top 66 of the carton 12 are folded downwardly in the direction of arrow A and likewise the struts 78, 80, 82, 84 associated with the bottom 68 of the carton are folded upwardly (arrow B) as shown in FIG. 2. Referring to FIG. 3, the struts 70, 72, 74, 76, 78, 80, 82, 84 are adhesively secured to the associated side 14, 16, 18, 20 via the respective glue lines 94 on the sides 14, 16, 18, 20. The struts are positioned on the sides immediately adjacent to the respective flap fold line 42, 44, 46, 48, 58, 60, 62, 64 and the fold lines 72*d*, 76*d*, 80*d*, 84*d* joining the respective strut 72, 76, 80, 84 to the bridge 72*a*, 76*a*, 80*a*, 84*a* that is coincident with the hole 86, 88, 90, 92 is likewise positioned coincident to the associated flap fold line 44, 48, 60, 64. The holes 86, 88, 90, 92 are provided and positioned coincident with the associated flap fold line so that when the respective flap is folded to form the top or bottom of the carton, the blank material does not bind or inhibit the free-folding operation of the flap.

Figure 4:
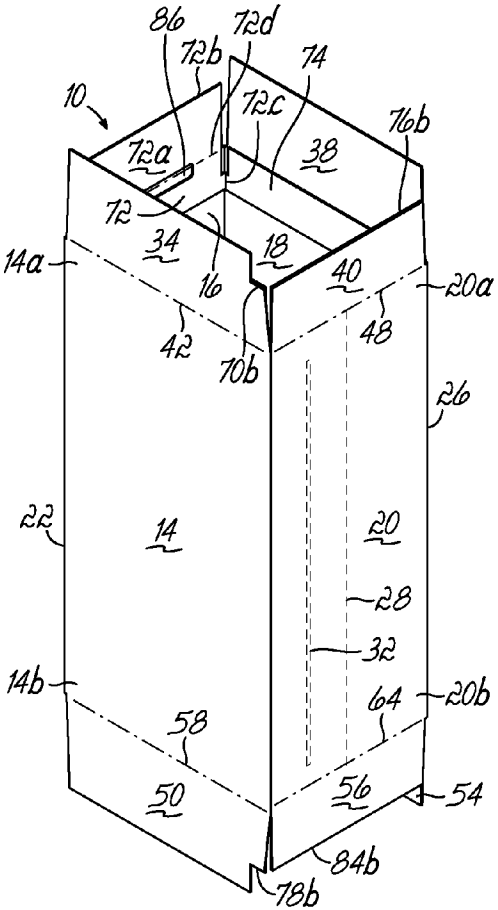
Figure 7:
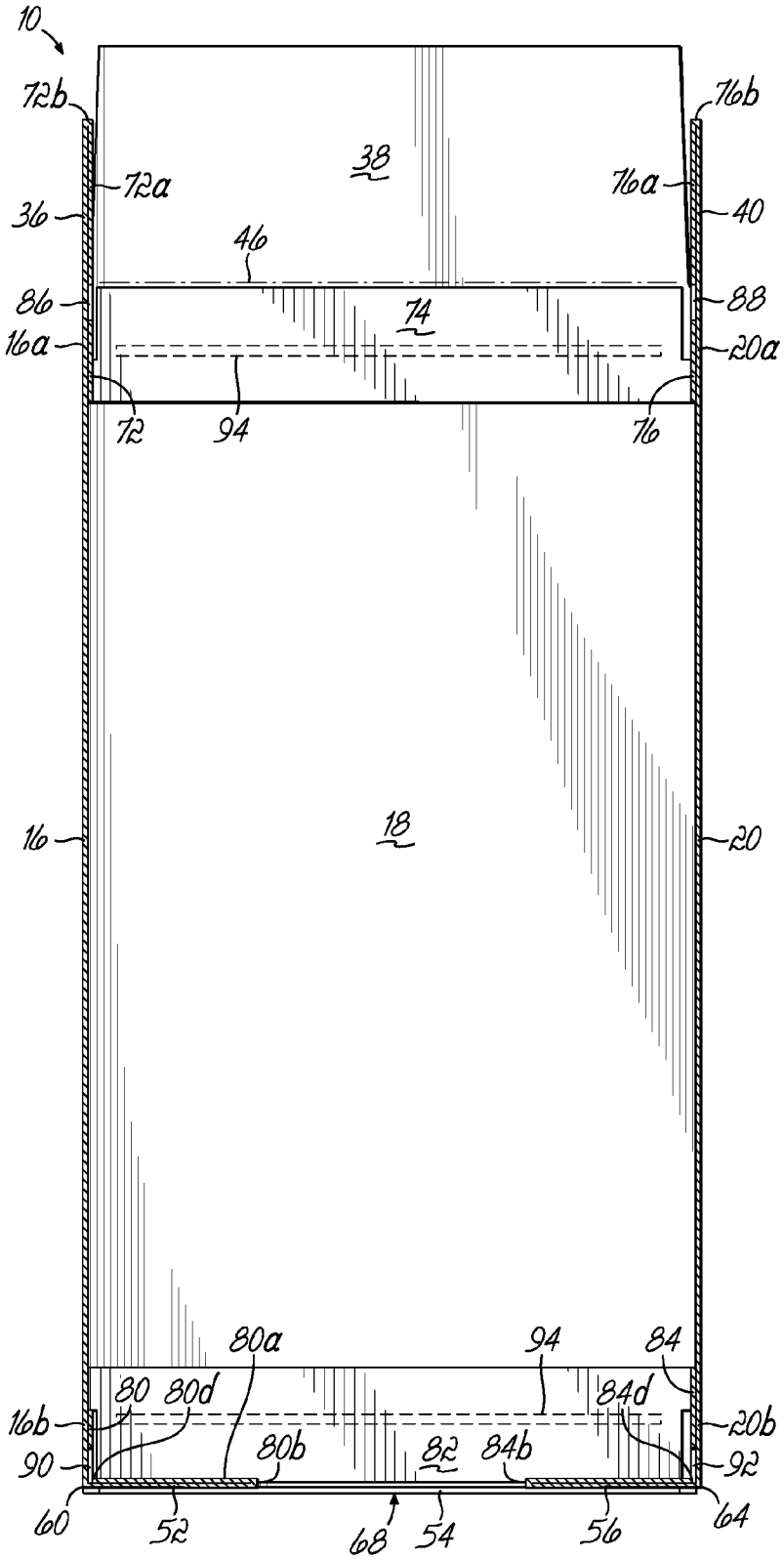
FIG. 7 is a cross-sectional view taken along line 7-7 of FIG. 5 showing the position of some of the struts in the open ended carton.

As shown by arrows C and D in FIG. 3, the sides 14, 16, 18, 20 are folded about the side fold lines 22, 24, 26 and the side flap 28 is folded about the side flap fold line 30 so as to be generally perpendicular relative to the adjacent sides. The glue line 22 on the side flap 28 adheres the side flap 28 to the opposite side 20 thereby forming the carton blank to into a tubular configuration as shown generally in FIG. 4. The bottom flaps 50, 52, 54, 56 are folded inwardly in the direction of arrows E and F so as to form the bottom 68 of the carton 12. Appropriate glue deposits or strips (not shown) are utilized to secure the bottom flaps 50, 52, 54, 56 together to form the bottom 68 of a carton 12. As shown in FIG. 7, the open top end of the carton 12 may be filled with carton contents and then the top flaps 34, 36, 38, are folded inwardly to form the top 66 of the carton 10. Once again, as shown in FIGS. 4 and 5, each hole 86, 88, 90, 92 adjacent the associated strut 72, 76, 80, 84 is aligned with and coincident to the respective flap fold line 44, 48, 60, 64 so that when the flap is folded inwardly to form the top or bottom of the carton, the strut and associated bridge do not bind or restrict movement of the flap 36, 40, 44, 48.

Figure 5:
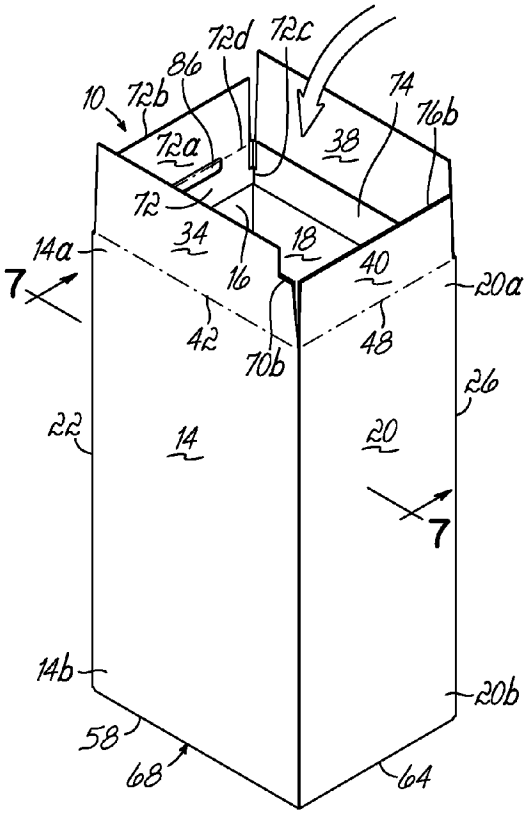

The cross-sectional view taken along line 7-7 of FIG. 5 shows the struts in FIG. 7 being positioned adjacent to the top and bottom 66, 68 of the carton 12 so that after the carton 12 is loaded, the struts 70, 72, 74, 76, 78, 80, 82, 84 provide added strength to resist buckling and deformation of the carton 12 in the associated regions. This affords the opportunity to stack multiple cartons 12 vertically one atop another and the struts inhibit damage, deformation of buckling of the carton 12. As such, a robust carton 12 is provided and may be formed from the carton blank 10 of thinner paperboard or other material thereby benefiting the carton 12 from a more economical carton blank 10 which still provides the requisite strength and resistance to buckling and deformation.

Figure 8:
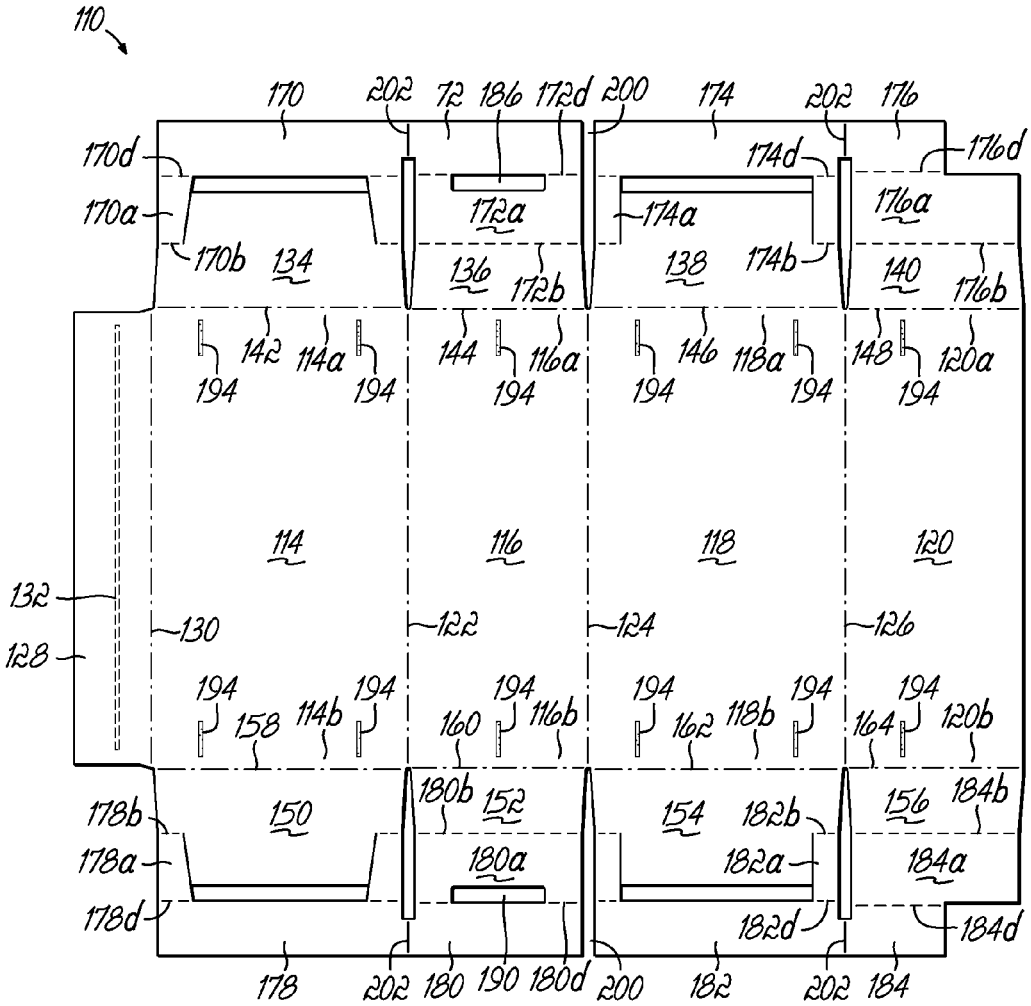
FIG. 8 is a plan view of a carton blank according to another embodiment of this invention.
Figure 9:
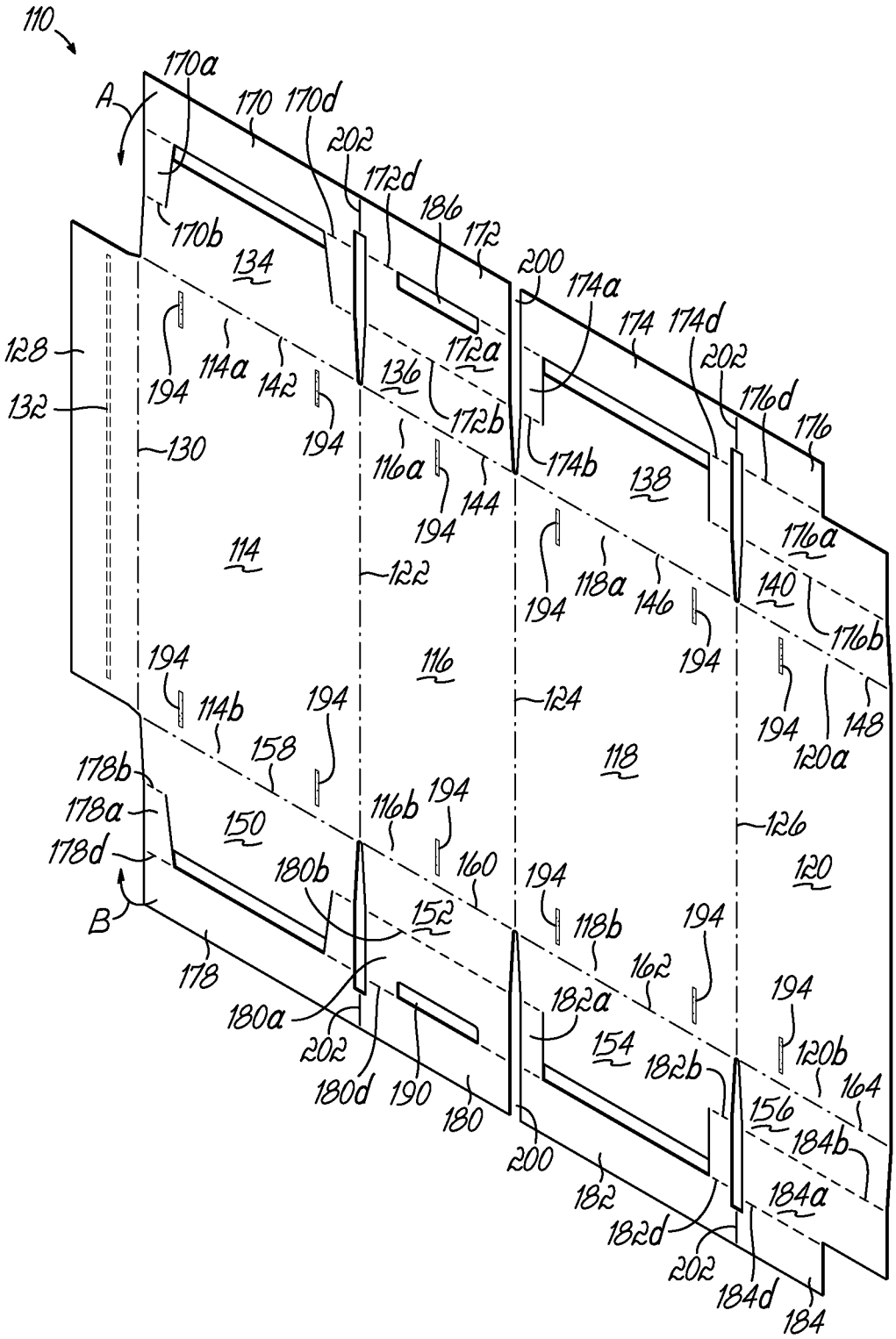
FIG. 9 is a perspective view of the carton blank of FIG. 8 with reinforcing struts connected to various flaps on the carton blank being folded as shown by the arrows.
Figure 10:
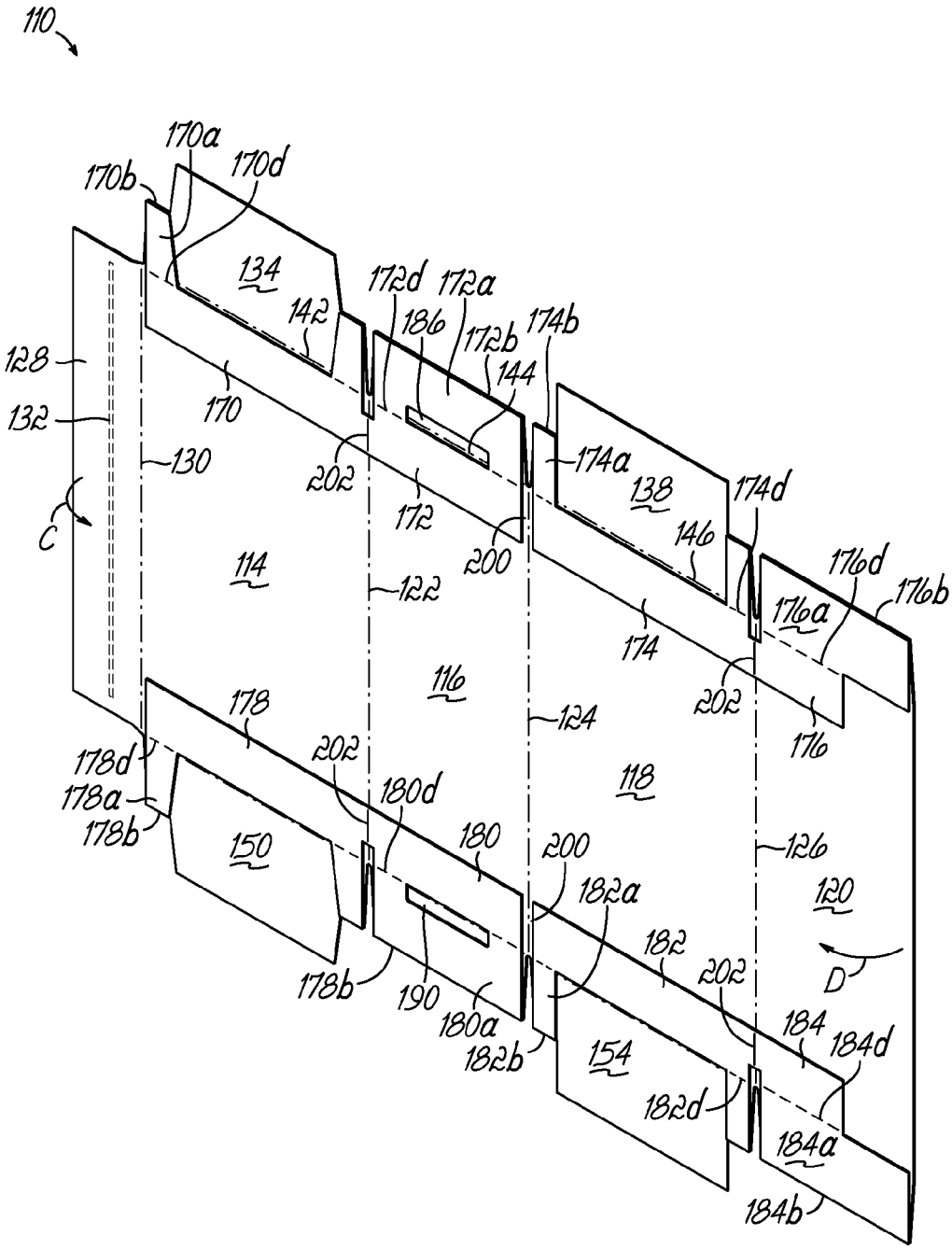
FIGS. 10-12 are sequential views of the carton blank of FIGS. 8-9 being folded into a closed ended carton.
Figure 13:
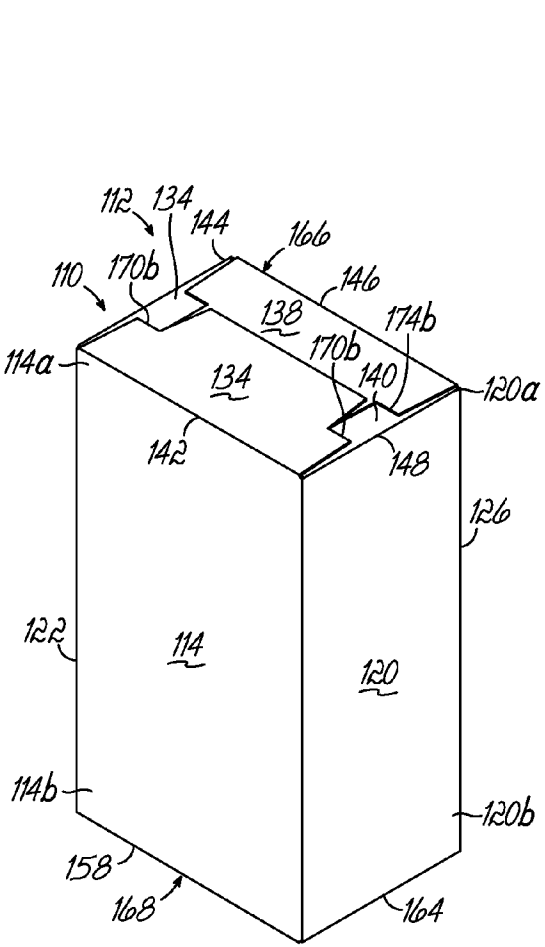
FIG. 13 is a perspective view of the carton formed from the carton blank of FIG. 8.
Figure 12:
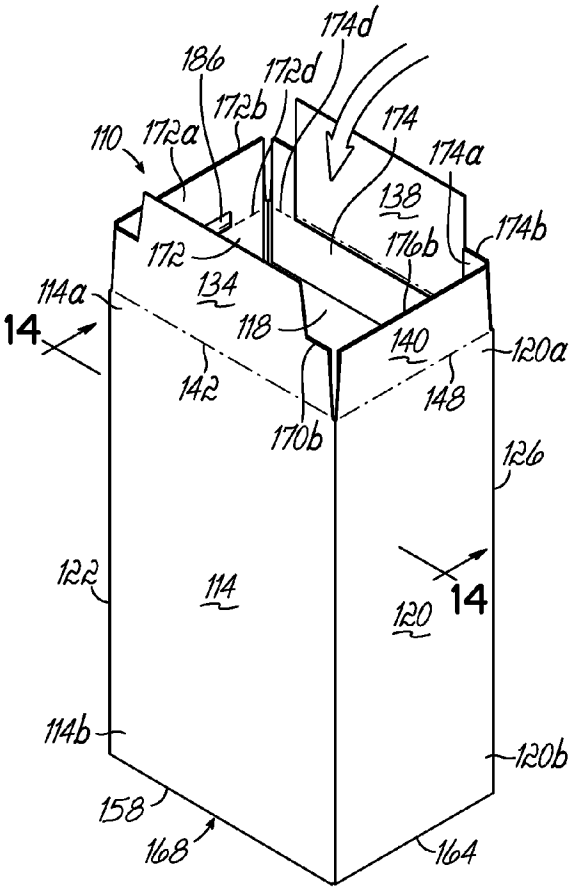
Figure 11:
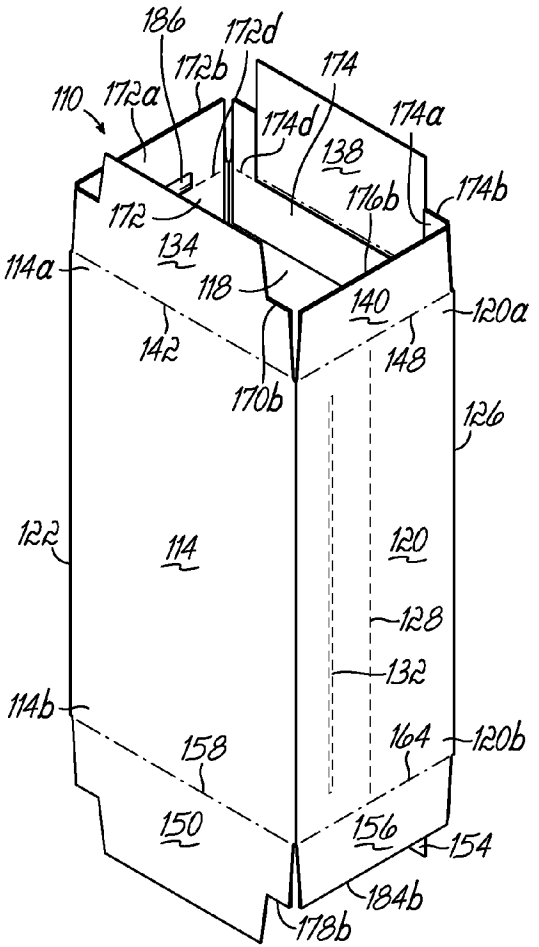
Figure 14:
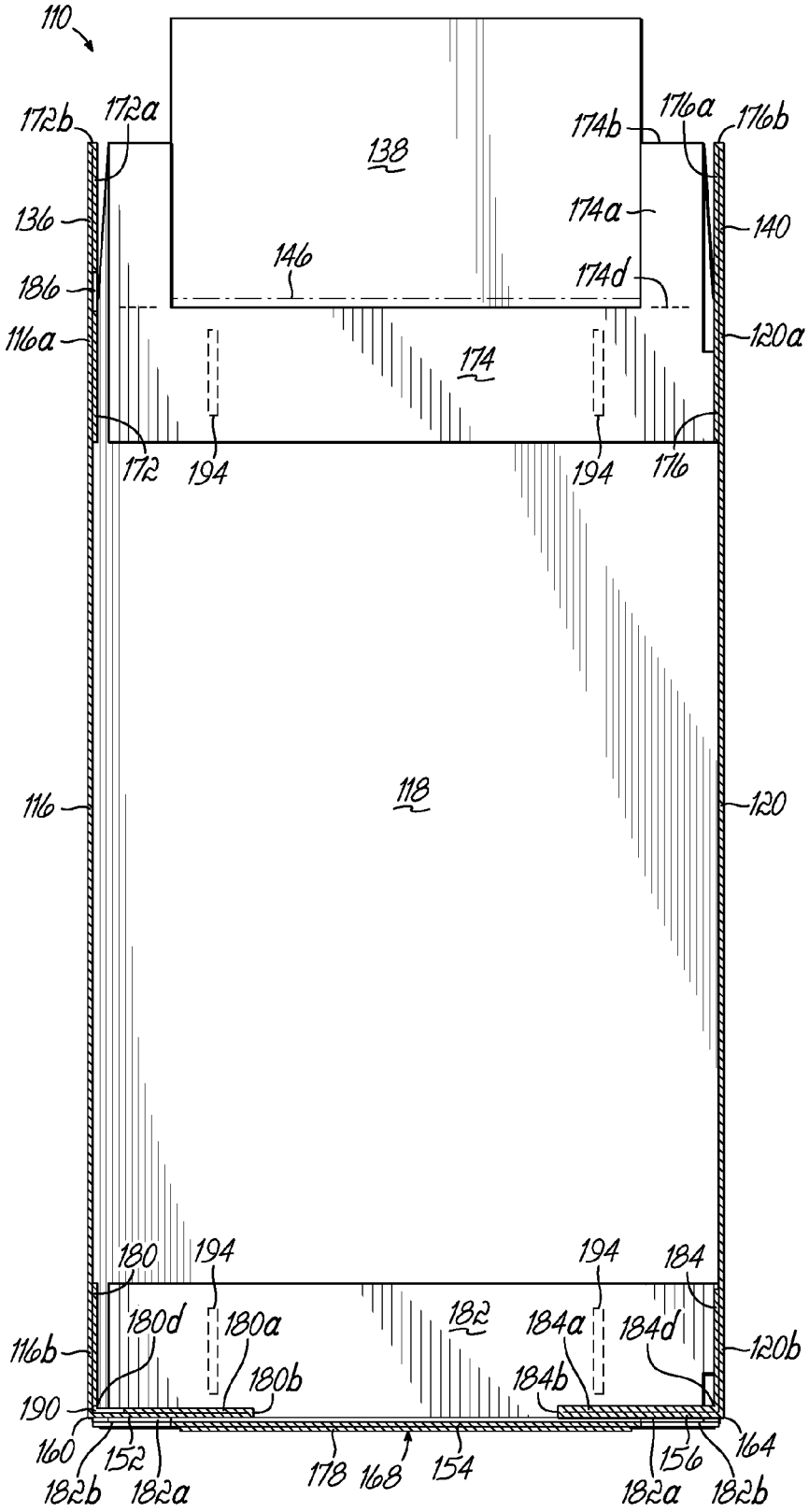
FIG. 14 is a cross-sectional view taken along line 14-14 of FIG. 12 showing the position of some of the struts in the open ended carton of this embodiment.

Referring to FIGS. 8-13, an additional embodiment of this invention is shown and the features, elements and components of this embodiment, which are similar or comparable to elements in the embodiment of FIGS. 1-7, are indicated by similar reference numerals in the 100 series of numbers. FIG. 8 shows a carton blank 110 including the sides 114, 116, 118, 120, associated side fold lines 122, 124, 126, side flap 128 and associated side flap fold line 130 and the top and bottom flaps 134, 136, 138, 140, 150, 152, 154, 156. Struts 170, 172, 174, 176, 178, 180, 182, 184 are connected to the respective flaps via bridges 170*a*, 172*a*, 176*a*, 178*a*, 180*a*, 184*a* and the various components are secured one to another via glue lines 194 as indicated in FIG. 8. One feature of the carton blank 110 of FIG. 8 which is distinguishable from the carton blank 10 of FIG. 1 is that the respective struts are separated from adjacent struts via gaps 200 or cut lines 202 unlike the fold lines which join the adjacent struts together in the carton blank 10 of FIG. 1. The construction and erection of the carton 112 from the carton blank 110 is shown sequentially in FIGS. 9-12 resulting in the erected filled carton 112 as shown in FIG. 13. A cross-sectional view of the interior of the carton 112 is shown in FIG. 14. The embodiment of FIGS. 8-14 is tailored to a pre-formed or pre-glued carton 112 rather than a carton blank which does not have the glue strips on it and the glue is added during the formation of the carton.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A carton blank adapted to be erected into a carton, the carton blank comprising:

a foldable sheet of material;

a plurality of sides serially connected to one another on the foldable sheet of material, each of the sides having a top end spaced from a bottom end;

a plurality of top flaps each of which is foldably connected to the top end of one of the sides;

wherein selected ones of the top flaps overlap one another to form a top end of the carton;

a plurality of bottom flaps each of which is foldably connected to the bottom end of one of the sides;

wherein selected ones of the bottom flaps overlap one another to form a bottom end of the carton; and a plurality of struts each extending beyond the selected ones of the top and bottom flaps, each strut being adapted to be folded into face to face juxtaposition and secured onto the side associated with the selected ones of the top and bottom flaps to thereby reinforce the side to which the strut is secured and inhibit deformation of the erected carton, wherein the combination of struts secured to each side do not cover substantially all of the side to which they are secured and the struts in combination extend substantially around all of the plurality of sides proximate at least one of the top and bottom ends of the carton.

2. The carton blank of claim 1 wherein each strut is integrally formed with the foldable sheet of material.

3. The carton blank of claim 1 further comprising:

a plurality of bridges each joining one of the struts to the selected one of the top and bottom flaps and being integrally joined therewith.

4. The carton blank of claim 3 wherein selected ones of the bridges extendless than the entire width of the associated flap.

5. The carton blank of claim 3 wherein selected ones of the bridges is are joined to the associated flap at a position spaced from a distal end of the associated flap.

6. The carton blank of claim 1 further comprising:

a plurality of longitudinally extending side fold lines each joining two adjacent sides together and enabling them to be folded relative to one another into a tubular configuration when the carton is erected from the carton blank.

7. The carton blank of claim 1 further comprising:

a plurality of laterally extending flap fold lines, each of which joins one of the top or bottom end flaps to the associated side and enabling the top and bottom flaps to be folded relative to the associated side to form the top and bottom sides, respectively, when the carton is erected from the carton blank.

8. The carton blank of claim 7 further comprising:

a hole in the sheet of material adjacent to the strut and adapted to be superimposed on at least a portion of the flap fold line associated with the flap to which the strut is connected to inhibit binding of the sheet of material when the flap is folded relative to the associated side and the carton is erected from the carton blank.

9. The carton blank of claim 1 wherein each of the flaps on one of the top or bottom ends has one of the struts associated therewith.

10. The carton blank of claim 9 wherein each of the flaps on the top and bottom ends has one of the struts.

11. The carton blank of claim 1 further comprising:

a side flap foldably connected to a terminal edge of one of the sides and adapted to be secured to an opposite one of the sides to form a tubular configuration when the carton is erected from the carton blank.

12. The carton blank of claim 1 wherein selected ones of the struts are not directly connected to the associated flap.

13. The carton blank of claim 1 wherein the struts associated with the selected ones of the top flaps are integrally connected with one another and the struts associated with the selected ones of the bottom flaps are integrally connected with one another.

14. The carton blank of claim 1 wherein at least one of the struts is spaced from and not directly connected to the associated flap.

15. A carton blank adapted to be erected into a carton, the carton blank comprising:

a foldable sheet of material;

a plurality of sides serially connected to one another on the foldable sheet of material, each of the sides having a top end spaced from a bottom end;

a plurality of longitudinally extending side fold lines each joining two adjacent sides together and enabling them to be folded relative to one another when the carton is erected from the carton blank;

a plurality of top flaps each of which is foldably connected to the top end of one of the sides, the top flaps forming a top end of the erected carton;

a plurality of bottom flaps each of which is foldably connected to the bottom end of one of the sides, the bottom flaps forming a bottom end of the erected carton;

a plurality of laterally extending flap fold lines, each of which joins one of the top or bottom end flaps to the associated side and enabling the top and bottom flaps to be folded relative to the associated side to form the top and bottom sides, respectively, when the carton is erected from the carton blank;

a plurality of struts each integrally formed with the foldable sheet of material and extending from one of the top or bottom flaps, the struts being adapted to be folded into face to face juxtaposition and secured onto an inside face of the side associated with the associated top or bottom flap to thereby reinforce the side to which the strut is secured and inhibit deformation of the erected carton, wherein each of the flaps on the top and bottom ends has one of the struts joined thereto;

wherein each strut is adjacent to the flap fold line associated with the flap to which it is connected when the strut is secured to the associated side of the carton blank;

wherein the strut is connected to a distal, longitudinal end of the associated flap; and a plurality of bridges each joining one the struts to the associated top or bottom flap and being integrally joined therewith, wherein the combination of struts secured to each side do not cover substantially all of the side to which they are secured and the struts in combination extend substantially around all of the plurality of sides proximate at least one of the top and bottom ends of the carton.

16. The carton blank of claim 15 further comprising:

a hole in the sheet of material adjacent to selected ones of the struts and adapted to be superimposed on at least a portion of the flap fold line associated with the flap to which the strut is connected to inhibit binding of the sheet of material when the flap is folded relative to the associated side and the carton is erected from the carton blank.

17. The carton blank of claim 15 wherein selected flaps do not have one of the bridges folded into face to face juxtaposition therewith when the carton is erected from the carton blank.

18. The carton blank of claim 15 wherein selected ones of the bridges extend less than the entire width of the associated flap.

19. The carton blank of claim 15 further comprising:

a side flap foldably connected to a terminal edge of one of the sides and adapted to be secured to an opposite one of the sides to form the carton blank into a tubular configuration when the carton is erected from the carton blank.

20. A carton formed of an integral sheet of foldable material, the carton comprising:

a plurality of sides serially connected to one another, each of the sides having a top end spaced from a bottom end;

a plurality of top flaps each of which is foldably connected to the top end of one of the sides;

wherein selected ones of the top flaps overlap one another to form a top end of the carton;

a plurality of bottom flaps each of which is foldably connected to the bottom end of one of the sides;

wherein selected ones of the bottom flaps overlap one another to form a bottom end of the carton; and a plurality of struts each extending beyond the selected ones of the top and bottom flaps, each strut being adapted to be folded into face to face juxtaposition and secured onto the side associated with the selected ones of the top and bottom flaps to thereby reinforce the side to which the strut is secured and inhibit deformation of the erected carton, wherein the combination of struts secured to each side do not cover substantially all of the side to which they are secured and the struts in combination extend substantially around all of the plurality of sides proximate at least one of the top and bottom ends of the carton.

21. The carton of claim 20 further comprising:

a plurality of bridges each joining one of the struts to the selected one of the top and bottom flaps and being integrally joined therewith.

22. The carton of claim 21 wherein selected ones of the bridges are joined to the associated flap at a position spaced from a distal end of the associated flap.

23. The carton of claim 20 wherein each strut is adjacent to the associated flap to which it is connected when the strut is secured to the associated side of the carton.

24. The carton of claim 20 further comprising:

a hole in the sheet of material adjacent to the strut and positioned at a juncture between the flap to which the strut is connected and the associated side to inhibit binding of the sheet of material when the flap is folded relative to the associated side.

25. The carton of claim 20 wherein each of the flaps on the top and bottom ends has one of the struts associated therewith.

26. The carton of claim 20 wherein selected ones of the struts is are not connected to a distal end of the associated flap.

27. The carton of claim 20 wherein the struts associated with the selected ones of the top flaps are integrally connected with one another and the struts associated with the selected ones of the bottom flaps are integrally connected with one another.

* * * * *

UNITED STATES PATENT AND TRADEMARK OFFICE

CERTIFICATE OF CORRECTION

PATENT NO. : 8,573,472 B2
APPLICATION NO. : 13/173019
DATED : November 5, 2013
INVENTOR(S) : Steven J. Block It is certified that error appears in the above-identified patent and that said Letters Patent is hereby corrected as shown below:

In the Specification:

Col. 3, line 51, "carton blank to includes" should read --carton blank 10 includes--.

Col. 4, line 61, "carton blank to into a" should read --carton blank 10 into a--.

In the Claims:

Col. 6, line 20, claim 4, "bridges extendless than" should read --bridges extend less than--.

Col. 6, line 23, claim 5, "bridges is are" should read --bridges are--.

Col. 8, line 52, claim 26, "struts is are" should read --struts are--.

Signed and Sealed this
Fourteenth Day of January, 2014

Michelle K. Lee

Michelle K. Lee
*Deputy Director of the United States Patent and Trademark Office*